United States Patent [19]

Meyer et al.

[11] Patent Number: 4,497,134

[45] Date of Patent: Feb. 5, 1985

[54] EXTERIOR LOUVER AND LOUVER APPARATUS

[76] Inventors: Bruce E. Meyer, 5649 E. Greenwood Pl., Denver, Colo. 80222; John S. McIntosh, 7165 Newton St., Westminster, Colo. 80030

[21] Appl. No.: 417,354

[22] Filed: Sep. 13, 1982

[51] Int. Cl.[3] ..... E06B 7/08

[52] U.S. Cl. ..... 49/91; 49/85; 98/121.2

[58] Field of Search ..... 49/91, 92, 51, 64, 85, 49/74; 160/236, 166, 166 A; 98/121 A

[56] References Cited

U.S. PATENT DOCUMENTS

| | | | |
|---|---|---|---|
| 317,798 | 5/1885 | Keller | 49/74 |
| 3,110,936 | 11/1963 | Berard | 49/92 |
| 3,113,355 | 12/1963 | Tracy et al. . | |
| 3,151,665 | 10/1964 | Stack . | |
| 3,257,755 | 6/1966 | Lewis | 49/85 |
| 3,290,823 | 12/1966 | Okumoto | 49/74 X |
| 3,305,970 | 2/1967 | Shapiro . | |
| 3,460,289 | 8/1969 | Toth | 49/92 X |
| 4,114,646 | 9/1978 | McCabe | 49/92 X |
| 4,292,763 | 10/1981 | Barnes et al. | 49/92 X |

*Primary Examiner*—Philip C. Kannan

*Attorney, Agent, or Firm*—Fields, Lewis, Pittenger & Rost

[57] ABSTRACT

Exterior louver apparatus includes a frame (11) with an oblique frame member (15) with a plurality of exterior louvers (19) having pivot pins in the ends with a universal-type joint (46, 47) in the oblique frame member supporting one end of the louver so that it remains free to pivot. Each louver has a flexible flap-like edge extension (36) that is preloaded against a landing surface (**22*c*) to prevent slapping of adjacent louvers under wind conditions. Each louver has both high strength and high heat insulating properties. A louver control includes a gear box (55**) inside one corner of the frame which prevents turning of the louvers from the outside. A linkage for an end louver turns it back to prevent water from entering the louver apparatus.

23 Claims, 9 Drawing Figures

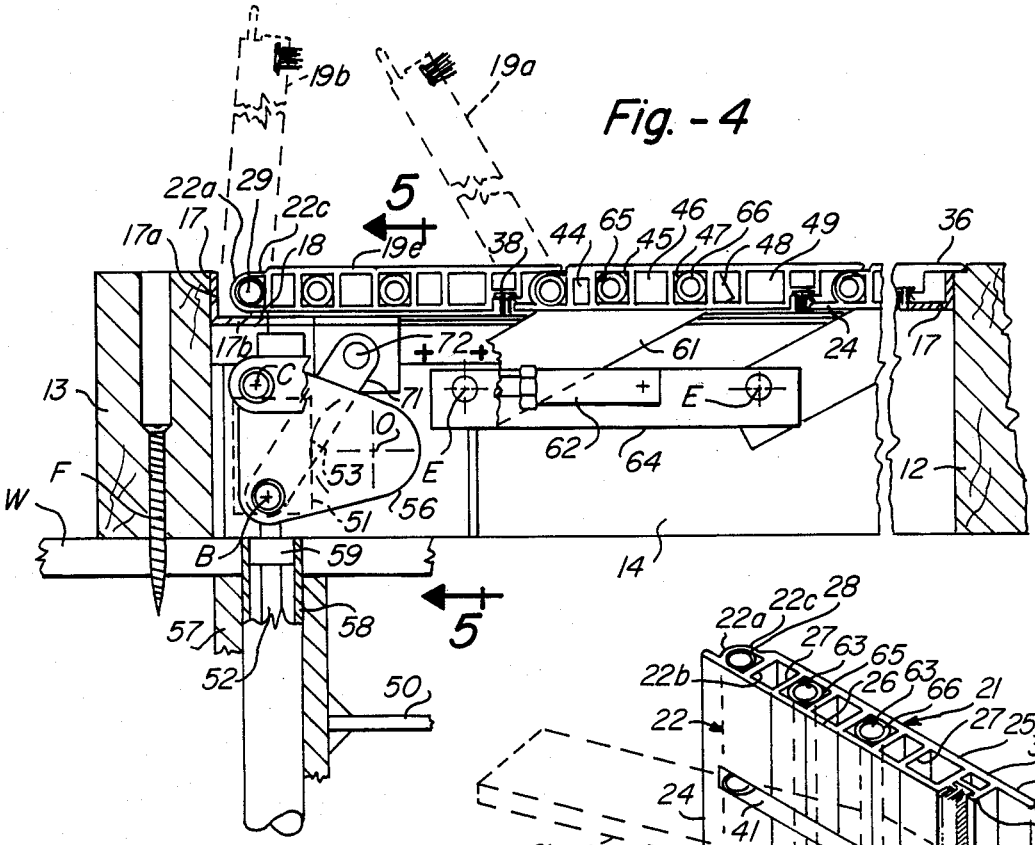
Fig. - 4
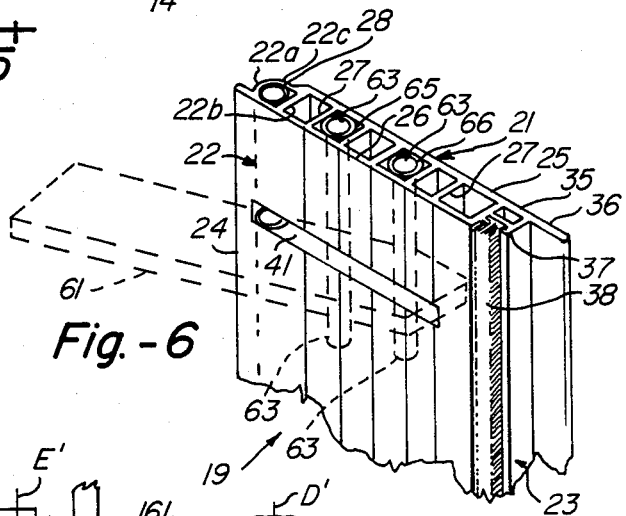
Fig. - 6
Fig.-9
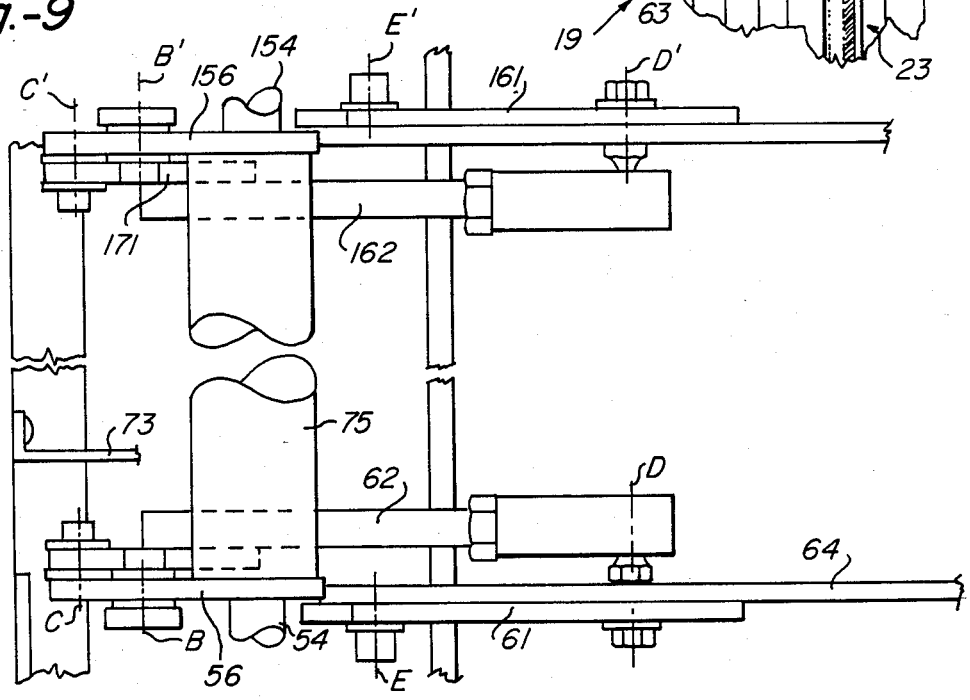

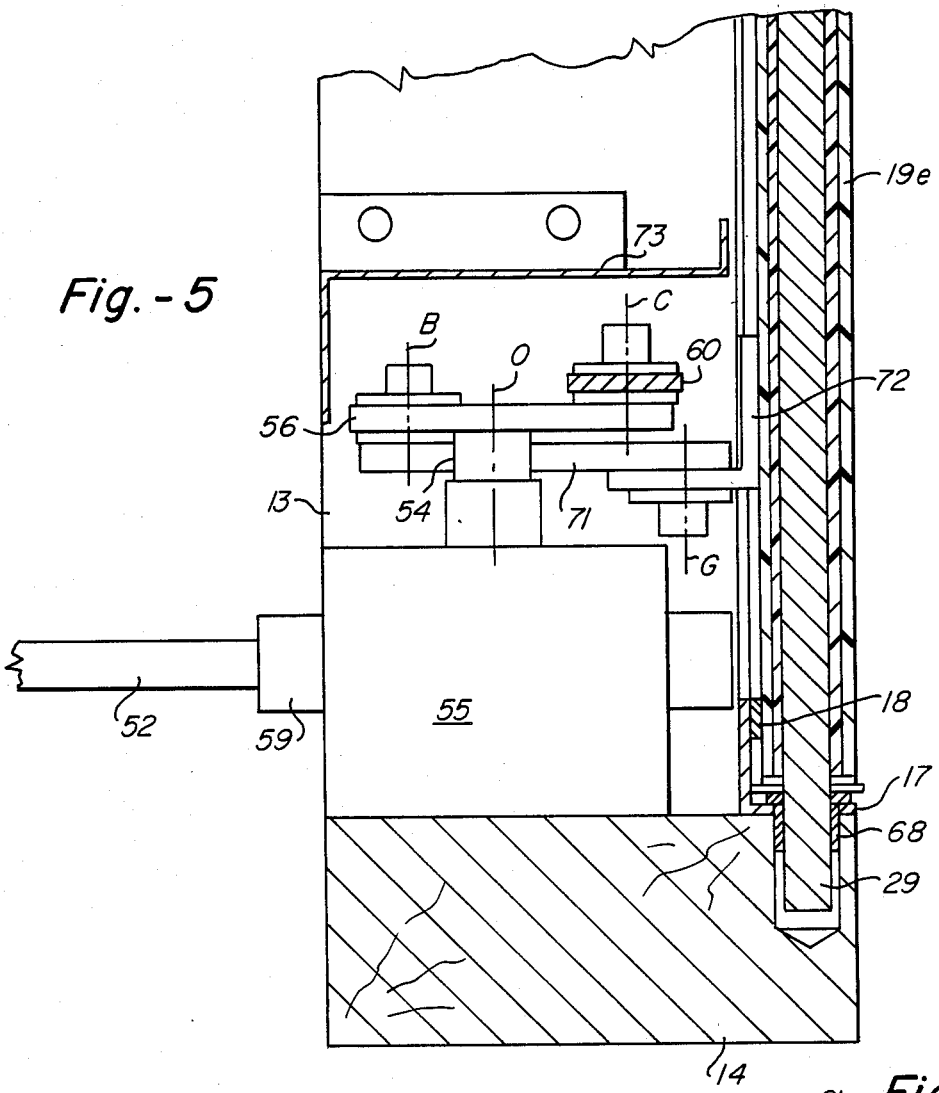
Fig. - 5
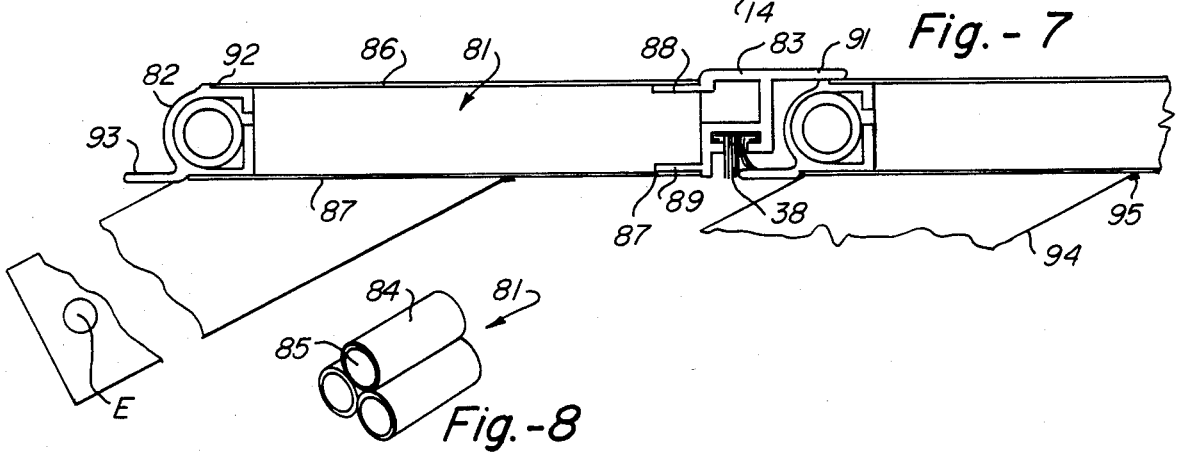
Fig. - 7
Fig. - 8

EXTERIOR LOUVER AND LOUVER APPARATUS

TECHNICAL FIELD

This invention relates to a novel and improved louver and louver apparatus particularly suited for exterior use.

BACKGROUND ART

Louvers of a variety of types of construction have heretofore been used in association with windows for the control of the rays of the sun, for security purposes, and for wind protection. In the past, exterior louvers for the most part have been constructed entirely of metal, glass or wood.

Some of the modern buildings have windows of oblique shapes including trapezoidal shapes. Louver frames constructed in oblique shapes are difficult to aline and have a tendency to become out of alinement or become misalined and this results in considerably more difficulty in maintaining the louvers free to pivot. Another common difficulty encountered with external louvers made of wood or metal is that the wind causes them to slap against one another. Metal louvers do not provide a thermal barrier since they are a good conductor of heat. Wood louvers have a tendency to warp when used in exterior situations.

Shapiro U.S. Pat. No. 3,305,970 discloses a centrally pivoted louver in which the frame members at the ends of the louvers are parallel to one another and which utilizes conventional journal bosses in which the ends of the louvers are mounted. This patent discloses a common lever for simultaneously moving a plurality of louvers.

Stack U.S. Pat. No. 3,151,665 discloses vertical louver doors supported between parallel-spaced tracks, the bottom track having a groove curved in cross section for the reception of a ball bearing. The ball bearing rolls along the groove. The top track has a rectangular groove for the reception of a ball bearing assembly carried by the top panel support.

Tracy et al U.S. Pat. No. 3,113,355 discloses a right angle gear arrangement in a drive train for louvers and utilizes a link common to a plurality of louvers for moving the louvers.

DISCLOSURE OF INVENTION

An external louver apparatus is disclosed wherein a plurality of exterior louvers are pivotally mounted in a frame having an oblique frame member supporting one end of each louver. Each louver has alined pivot pins extending out from opposite ends adjacent one longitudinal edge. These pivot pins extend into holes in oppositely disposed frame members. Bearing means in the holes in the oblique frame member includes a ball-like bearing on the pivot pin and a sleeve bearing in the oblique frame member to maintain a free pivot action for each louver even though there is an inaccurate drilling of the holes in the frame members, a misalinement of the frame members, or a shift in position of the frame member.

One form of the louver has a core section and opposed longitudinal edge sections made entirely from a one-piece vinyl plastic extrusion. The core section has spaced outer and inner walls connected by transverse ribs spaced from one another to provide a rigid panel structure and also provide a plurality of side by side tubular air spaces which extend along the louver, resulting in a heat insulating cellular volume between the walls. In another form of the invention the core section is a sandwich structure with a transverse honeycomb core filled with foam plastic covered by sheets of aluminum with the longitudinal edge sections of the louver being made of vinyl plastic extrusions. Each louver has a landing surface at one edge and a flexible flap-like edge extension along the other edge which, when one louver is pulled against the other, produces a preloading on the louver to prevent a slapping sound due to wind or the like.

A louver position control apparatus includes a right angle gear drive in a housing located in one corner of the frame and entirely within the frame, the drive preventing movement of the louvers from the outside. The linkage provides a particular movement for the longest louver to keep out weather.

BRIEF DESCRIPTION OF DRAWINGS

The details of this invention will be described in connection with the accompanying drawings, in which:

FIG. 4 is a top plan view of a portion of the louver apparatus of FIGS. 1–3 with two of the louvers shown in dashed lines in the open position and showing the relationship of the apparatus to the window of a building;

FIG. 5 is a sectional view taken along lines 5—5 of FIG. 4;

FIG. 6 is a fragmentary perspective view of the louver shown in FIGS. 1–4 with an individual lever arm for that louver shown in dashed lines;

FIG. 7 is a top view of another form of exterior louver;

FIG. 8 is a fragmentary view of the honeycomb core; and

FIG. 9 is a dual drive arrangement with upper and lower individual lever arms for each louver.

DETAILED DESCRIPTION

Figure 1:
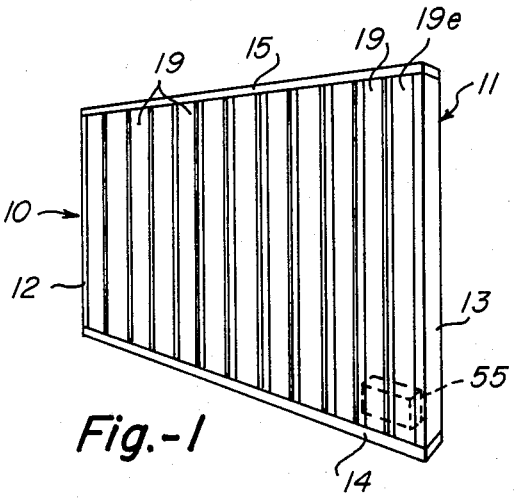
FIG. 1 is a front perspective view of exterior louver apparatus embodying features of the present invention.
Figure 3:
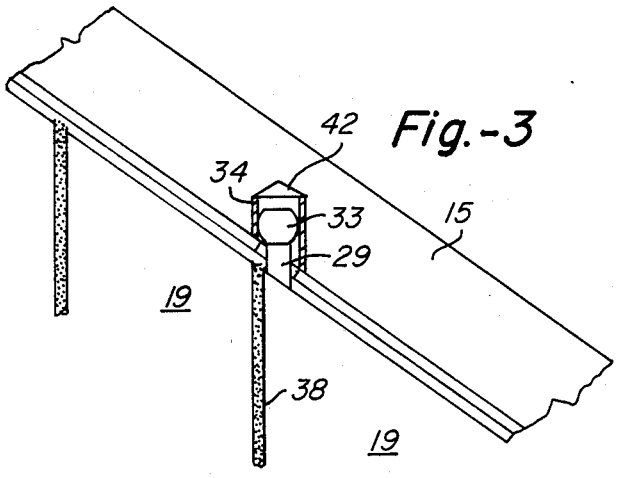
FIG. 3 is an enlarged rear elevation fragment showing the pivotal mounting for the pivot pin in the oblique frame member.

Referring now to FIG. 1, there is shown an external louver apparatus 10 which includes a frame 11 comprised of a pair of opposed frame members 12 and 13 arranged parallel to one another and an opposed pair of oblique frame members 14 and 15. Frame member 15 is referred to as an oblique frame member since it is not perpendicular to members 12 and 13 and is not parallel to member 14. Member 14 is the perpendicular frame member since it is perpendicular to members 12 and 13 in forming two right angle corners of the frame. The two pairs of frame members are connected in a trapezoidal configuration having a wider end portion and a narrower end portion.

There is further provided a metal frame 17, preferably aluminum, recessed in the front of the frame to receive the louver, the frame 17 having a leg 17*a* extending along frame member 13 and a leg 17*b* projecting into the opening of frame 11. A flexible gasket 18 extends along the inner leg, and an inner surface of the end louver bears against this gasket in the closed louver position.

A plurality of exterior louvers 19 extend between the non-parallel frame members 14 and 15 in a parallel-spaced relationship and are pivoted to move between open and closed positions. These louvers 19 decrease in length from the wider end portion of the frame to the narrower portion of the frame. In general, in the open position the louvers are disposed face to face with a space between adjacent pairs, and in the closed position the louvers are disposed in an edge to edge abutting relationship. Each louver 19 shown, except the longest louver 19*e*, of an identical construction, which is a one-piece vinyl plastic extrusion.

Each louver 19 shown in FIGS. 1–6 has a generally rectangular cross section with a core section 21 and opposed longitudinal edge sections 22 and 23, herein referred to as the pivoted edge section 22 and the free edge section 23. One end of the louver is cut along an angle to correspond with the angle of the oblique frame member.

The core section 21 includes an outer wall 25 and an inner wall 26 spaced from the outer wall, together with a plurality of spaced transverse connecting ribs 27 spaced from one another and rigidly connected to the inside of the walls to provide a series of side by side tubular air spaces extending along the core section. The core section shown has six tubular air spaces proceeding from the pivoted edge section 22 to the free edge section 23 and comprising a narrow space 44, three wider spaces 45, 46 and 47, a narrower space 48, and a wider space 49. For added strength a length of square rebar may be inserted into the spaces, and particularly space 49. The core section and opposed edge sections shown in FIGS. 1–6 are preferably made as a one-piece vinyl plastic extrusion. This louver construction is a rigid panel structure with dead air spaces and also forms a cellular heat insulating volume. The vinyl plastic ribs 27 have low heat conductivity.

The pivoted edge section 22 is of a generally tubular shape with an outer semicircularly shaped portion 22*a* joined to an inner channel-shaped portion 22*b*. The edge section is formed with a recessed landing surface 22*c*. An inside flexible flap-like edge extension 24 extends out from one leg of the channel portion in the plane of the inner wall on all louvers except the wide end louver 19*e*.

A plastic sleeve 28 is shown inserted into the pivoted edge section 22 at each end of the louver and this sleeve 28 is affixed therein by an adhesive. A metal pivot pin 29 is inserted into each sleeve and held in a force-fitted relationship to be an integral part of the louver extrusion, and these pivot pins extend beyond the ends of the core section. Each end portion of the louver has a notched section 31 which enables it to clear the metal frame when pivoting between open and closed positions. The end of the louver is shown to have a vinyl cap 32.

The free edge section 23 has a smaller tubular section 35 from which a flexible flap 36 extends in the plane of the outer wall and a channel section 37 on the inside for supporting a weatherproofing pile 38 that extends transverse to the faces of the core section with the pile projecting toward the inside.

A transverse slot 41 is cut in the inner wall portion 22 of each louver adjacent one end to receive an individual lever arm 61, shown in dashed lines, used in pivoting the associated louver. Lever arm 61 is described more fully hereinafter.

For the pivoted mounting of each louver in the frame, a hole 42 is formed in oblique frame member 15 and a hole 43 is formed in perpendicular frame member 14. Pivot pin 29 in hole 42 carries a ball-like bearing 33 that mates in a sleeve bearing 34 in hole 42 to form a universal-type joint which provides a free pivot action for each louver 19 with respect to the frame members 14 and 15 even though the holes 42 and 43 are not drilled in precisely the correct location, the bearing is not alined in the hole, or there is a shift in position of the frame members 14 and 15. A sleeve bearing 68 is provided in the hole 43 which serves as a bearing for supporting the other pivot pin for free rotation. A washer 40 is shown between bearing 68 and the end of the louver.

The assembly of the louvers in the frame 11 with the louvers in the closed position has the flexible flap-like edge extension 36 recessed in and adjacent the landing surface 22*c* to be flush with the outer surface of the outer wall 25.

The significance of having the flexible flap-like edge extension 36 is that the louver position control described hereinafter applies a pulling force to the louver so that the flexible edge extension is drawn or preloaded from a straight shape into a slightly curved shape. This curve is greatest where the individual lever arm is attached to the louver and the curvature lessens along the length of the louver away from the individual lever arm. The flexible gasket seal 18 on the inner leg of the metal frame 17 enables the louver to be pulled inwardly so that the flexible edge extension can be drawn or preloaded into the slight curve. This preloading of the flap-like edge extension enables all of the inside surface of the louver to tightly engage the flexible gasket to prevent the slapping of adjacent louvers during a windstorm.

A louver position control apparatus shown includes a worm 51 of a right angle gear assembly which is mounted for rotation in close proximity to both inside corner-forming surfaces of the frame members 13 and 14 at the wide end portion of the frame. It is understood that the gear assembly could be located at the narrower end portion of the frame if desired. The worm 51 is mounted on one end of a drive shaft 52 that extends from the inside of the frame through the rear to a suitable turning handle or the like (not shown) to facilitate the manual rotation of the drive shaft 52.

The frame 11 is shown in FIG. 4 as mounted over a window glass 50 in a building having a window frame 57. In installing the louver on the building a hole is drilled in the window frame and a plastic sleeve 58 is inserted into this hole. The drive shaft 52 with a bearing 59 is inserted into the sleeve. The manual turn mechanism (not shown) for the drive shaft is fastened to the drive shaft 52 on the inside end of the window frame. The frame 11 is fastened to the outer wall W of the building outside the window frame by suitable bolts F that extend through holes drilled in the frame members.

Figure 2:
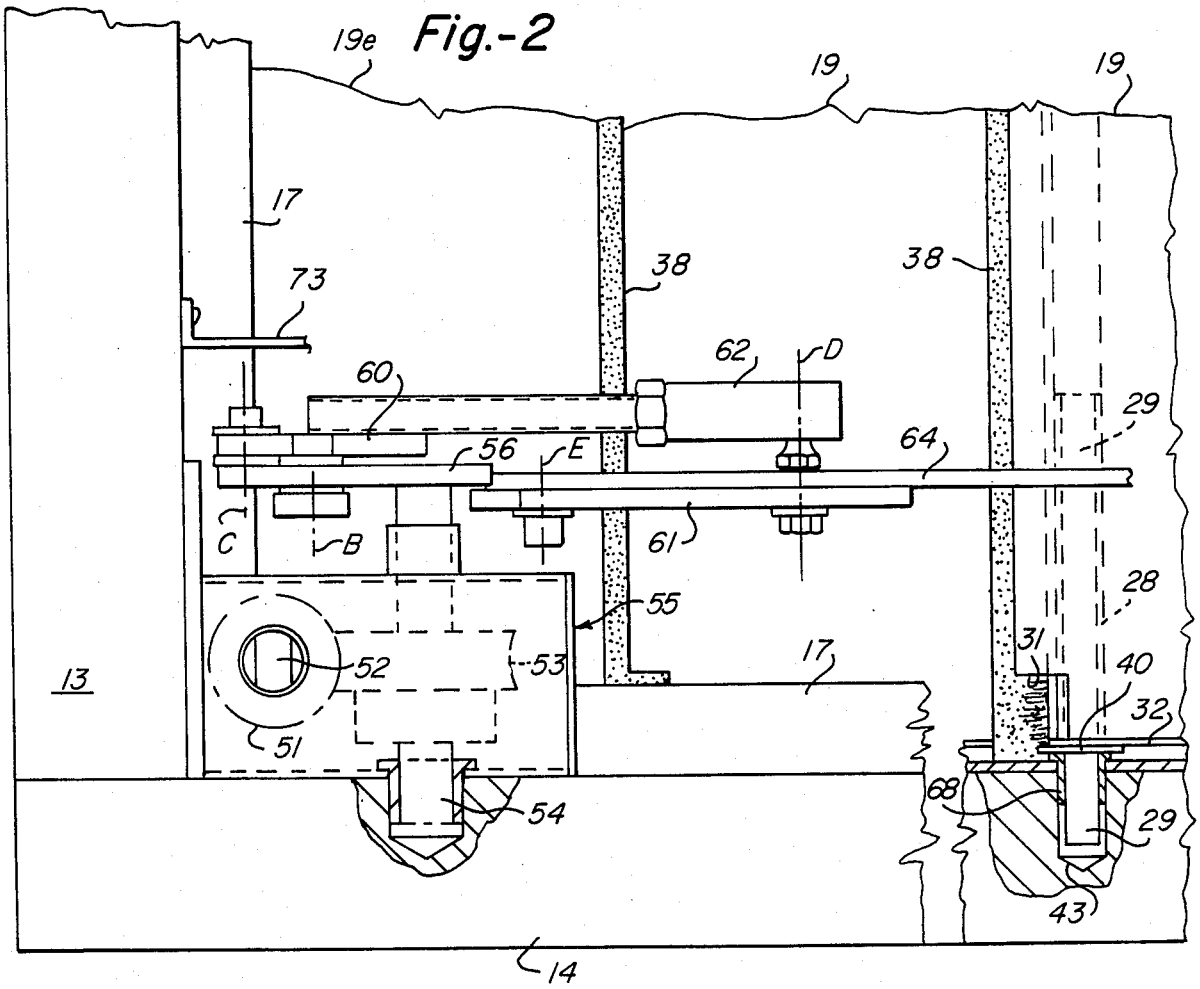
FIG. 2 is a rear elevation view of a lower right corner portion of the louver apparatus shown in FIG. 1.

A worm gear 53 is carried on an output shaft 54. Shaft 54 is journaled at one end in the perpendicular frame member 14. Gear 53 meshes with the worm 51. This worm gear assembly is contained in a rectangular gear box or housing 55 that fits within the width dimensions of the frame members rearwardly of the recessed closed louvers, as best seen in FIGS. 2 and 4. With this construction no structure except the drive shaft projects forwardly or rearwardly of the frame. A triangularly shaped drive plate 56 is mounted on the inner free end of the output shaft 54 for conjoint rotation therewith.

A primary lever arm 62, adjustable in length, is rigidly connected at one end to a connecting plate 60 which in turn connects to the drive plate 56 at a pivot C and pivotally connects at the other end to a common lever arm 64 at pivot D. An individual lever arm 61 for each louver, except the longest end louver, has one end pivotally connected at pivot E on the common lever arm 64. The opposite end of the individual lever arm 61 is fitted in the slot 41 in the louver and pins 63 are inserted into plastic sleeves 65 and 66, respectively, in spaces 45 and 47, respectively, from one end of the louver and into two holes in the individual lever arm. Sleeves 65 and 66 are fastened to the extruded body in the same manner as sleeve 28 above described. This construction permits the louvers to be extruded in standard lengths, cut to length as required, the slot 41 cut therein, and the sleeves and pins installed with a minimum of cost and time expended.

In the closed position the individual lever arm 61 is at a sharp angle to the common lever arm 64 and, when the common lever arm is moved to the right, as seen in FIG. 4, the louver pivots about its pivotal axis to the open position indicated in dashed lines at 19*a*. Each successive louver has its individual lever arm pivotally connected to the common lever arm 64 so that all louvers move simultaneously between open and shut positions when the drive plate 56 is rotated first in one direction and then in the opposite direction.

A lever arm 71 for the end louver 19*e* pivotally connects at one end to the drive plate at a pivot B and the opposite end is pivotally connected at pivot G to the bracket 72. Bracket 72 is rigidly fastened to the inner face of louver 19*e*. Upon rotation of the drive plate 56, the end louver 19*e* moves to a position approximately perpendicular to the frame and then pivots back to an inclined position, as indicated in dashed lines at 19*b*. When the end louver 19*e* is placed in a top louver orientation it serves as a weather shield for the window whereby water and the like are kept out. This linkage and worm gear assembly prevents the louvers from being pivotal from the outside of the frame. A dust cover 73 is shown mounted above the gear box and extends across the full length of the louver apparatus.

Another form of louver construction shown in FIGS. 7 and 8 has a sandwich type core section 81 and opposed edge sections 82 and 83. The honeycomb core section sandwich 81 is comprised of a transversely extending honeycomb, preferably of an ABS plastic, having a plurality of tubular bodies 84 of circular cross section arranged side by side and filled with foam plastic 85, preferably polyurethane. An outer wall 86, preferably an aluminum skin, and an inner wall 87, preferably an aluminum skin, are rigidly affixed to the ends of the tubular bodies to form outer and inner walls, respectively, of the core section.

The pivot edge section 82 is extruded from vinyl and is generally the same shape as the edge section above described but has recesses in both the outer and inner faces to receive the thickness of the louver skins. The free edge section 83 is extruded from vinyl and is the same shape as the free edge section above described but is formed with a pair of opposed wall extensions 88 and 89 which provide support surfaces for the cover skins.

In this form the flexible flap-like edge extension 91 is above the plane of the outer skin 86 and fits on a landing surface 92 provided by the outer skin 86 and the flap-like edge extension is not flush with the outer skin but rather is outside the plane of the outer skin. An inside flexible flap-like edge extension 93 is shown on the pivot edge section with the pile engaging this extension. The sandwich core would have an R value of approximately 4 to 4.5.

A modified form of individual lever arm 94 has a flange 95 that extends along the inside surface of the louver and is affixed thereto as by rivets or the like.

A dual linkage arrangement is shown in FIG. 9 for use with longer louvers. In this arrangement a shaft extension 75 is mounted between drive plate 56 and a drive plate 156 at the opposite end of the louver mounted on a support shaft 154. A primary lever arm 162 pivotally connects to drive plate 156 at pivot Cl′ and at the other end to a common lever arm 164 at pivot D′. An individual lever arm 161 has one end pivotally connected at E′ on the common lever arm 164. The opposite end of the individual lever arm 161 is fastened to the louver to complete the linkage connection to the louver.

A second lever arm 171 pivotally connects at one end to the drive plate 156 at pivot B′ and the opposite end of lever arm 171 fastens to the louver. Upon rotation of drive shaft 54 the louvers are moved via the linkage by forces applied at two spaced points between the ends of each louver.

From the foregoing it is clear that the exterior louver apparatus is effective in controlling the sun's rays, is strong so as to serve as a security device and protect windows against wind breakage and debris, has good heat insulating properties, is easy to install, and the louvers remain easy to pivot.

Although the present invention has been described with a certain degree of particularity, it is understood that the present disclosure has been made by way of example and that changes in details of structure may be made without departing from the spirit thereof.

What is claimed is:

1. In an exterior louver apparatus, the combination comprising:

a frame including an oblique frame member and another frame member opposite and spaced from said oblique frame member;

a plurality of exterior louvers extending between said frame members, said louvers being movable about a pivotal axis between open and closed positions, each said louver having pivot pins at the opposite ends adjacent one longitudinal edge, said pivot pins being supported in alined holes in said frame members in a bearing means, means including a sleeve bearing and a ball-like bearing which together form a universal-type joint at one end of each louver to provide for a free pivot action of each louver; and a louver position control means extending between and pivotally connected to each louver for simultaneously rotating said louvers about their pivotal axes between said open and closed positions.

2. In louver apparatus as set forth in claim 1 wherein said ball-like bearing is carried by one of said pivot pins and said sleeve bearing is mounted in said hole in the oblique frame member.

3. In louver apparatus as set forth in claim 2 wherein the pivot pin extending into the hole in said another frame member is carried in a second sleeve bearing for supporting each louver.

4. In louver apparatus as set forth in claim 1 wherein said connection between said control means and each louver includes a pair of fastening pins inserted into spaced holes in one end of said louver and an individual lever arm for each louver extending through a slot in an inner wall of said louver, said lever arm having a pair of apertures receiving said pins.

5. In louver apparatus as set forth in claim 1 wherein said connection between said control means and each louver includes a bracket fastened to an inside face of the louver and an individual lever arm for each louver connected to said bracket.

6. In louver apparatus as set forth in claim 1 wherein each louver has a flexible flap extending from one edge and a landing surface at the opposite edge, the flexible flap of one louver being preloaded against the landing surface of the adjacent louver to prevent slapping as by the wind in the closed louver position.

7. In louver apparatus as set forth in claim 6 wherein said landing surface is recessed below the outer surface of the louver so that said flexible flap is flush with said outer surface in the closed position.

8. In louver apparatus as set forth in claim 6 wherein said louver has a channel disposed inside said flap for supporting a weatherproofing pile.

9. In louver apparatus as set forth in claim 8 wherein said pivoted edge section has an inside flap against which the pile of an adjacent louver is seated in the closed louver position.

10. In louver apparatus as set forth in claim 1 wherein said louver position control means includes a worm gear asembly for transmitting mechanical power to the louvers, said assembly including a worm having its periphery in close proximity to both surfaces of two frame members of said frame, forming a corner, and a worm gear having its width within the width of said frame members, said worm gear preventing the opening of said louvers by turning from the outside of said frame.

11. In louver apparatus as set forth in claim 10 including a drive shaft for said worm gear and a drive plate mounted on said drive shaft, a primary linkage arm having one end pivotally connected to said drive plate, and an individual lever arm pivotally connected at one end to the primary linkage arm and pivotally connected at the opposite end to a louver whereby, upon movement of said primary linkage arm, a plurality of the louvers are moved via an associated individual lever arm.

12. In louver apparatus as set forth in claim 11 including a second drive plate on the end of a shaft extension driven by said worm gear, said second drive plate moving a second primary linkage arm and a second individual lever arm connected adjacent the opposite end of an associated louver whereby the mechanical power is connected at two spaced positions along each louver.

13. In an exterior louver apparatus for use over the outside of a window of a building, the combination comprising:

a frame including a first pair of frame members arranged parallel to and spaced from one another and a second pair of frame members arranged oblique to and spaced from one another, one of said second pair being an oblique frame member and the other of said second pair being a perpendicular frame member;

a plurality of exterior louvers extending between said second pair of frame members in a parallel relation to one another, said louvers being movable about a pivotal axis between open and closed positions, said louvers being recessed in the outer face of the frame and substantially flush with the outer face in the closed position, each said louver having pivot pins at the opposite ends adjacent one longitudinal edge, said pivot pins being supported in alined holes in said second pair of frame members in a bearing means, said bearing means including a sleeve bearing and a ball-like bearing which together form a universal-type joint at one end of each louver to provide for a free pivot action of each louver even though the holes formed in the second pair of frame members are out of alinement or there is a misalinement in the oblique frame member or a shift of position in the oblique frame member; and a louver position control means extending between and pivotally connected to each louver for simultaneously rotating said louvers about their pivotal axes between said open and closed positions.

14. In an exterior louver apparatus including a plurality of exterior louvers extending between oppositely disposed frame members, position control means for pivoting said louvers between open and closed positions, and arm means connected between each louver and said position control means, an improved exterior louver comprising:

a core section having spaced outer and inner walls and opposed longitudinal edge sections, said outer wall being spaced from said inner wall by transverse rigid connecting structure of a low heat conductivity rigidly attached to said walls, to form a rigid panel structure with a cellular heat insulating volume between said walls, one of said edge sections having oppositely extending pivot pins about which the louver pivots and having a landing surface projecting beyond said outer wall, the other of said edge sections having a flexible flap-like edge extension projecting beyond said outer wall that is pulled into a slight curvature along its length against the landing surface of a next adjacent similar louver to provide a preloaded condition by a pulling force applied by said pulling control means via said arm means to form a tight closure between louvers to prevent slapping in the wind.

15. In louver apparatus as set forth in claim 14 wherein said outer and inner walls are connected by spaced ribs to form a plurality of longitudinally extending tubular air spaces between said walls and said ribs.

16. In louver apparatus as set forth in claim 14 wherein said core and edge sections are formed entirely of a one-piece vinyl extrusion.

17. In louver apparatus as set forth in claim 14 wherein said outer and inner walls are connected by a plastic honeycomb having transversely extending tubular members extending between said walls.

18. In louver apparatus as set forth in claim 17 wherein said tubular members are filled with a foam plastic.

19. In louver apparatus as set forth in claim 17 wherein said outer and inner walls are a metallic skin.

20. In louver apparatus as set forth in claim 14 including a second flap-like edge extension extending out from the other horizontal edge section in the plane of said inner wall on which a portion of the weatherproofing pile of the next adjacent louver is seated in the closed louver position.

21. In louver apparatus as set forth in claim 14 wherein said curvature is greatest where said arm means is attached to the associated louver.

22. In louver apparatus as set forth in claim 14 wherein the connection between said arm means and each louver includes a pair of fastening pins inserted into spaced holes in one end of said louver and an individual lever arm for each louver extending through a slot in an inner wall of said louver, said lever arm having a pair of apertures receiving said pins.

23. In louver apparatus as set forth in claim 14 including:

first sealing means carried by said frame members extending transverse to an end portion of each louver to engage and form a seal with each louver in the closed position;

longitudinal frame members disposed adjacent and extending along the lengthwise extent of a pair of oppositely disposed of said louvers; and second sealing means carried by said longitudinal frame members to engage and form a seal with said pair in the closed position.

* * * * *